US012203478B1

(12) United States Patent
Guo

(10) Patent No.: US 12,203,478 B1
(45) Date of Patent: Jan. 21, 2025

(54) CEILING FAN BLADE INSTALLATION STRUCTURE

(71) Applicant: Zhongshan Sanfan Electrical Appliance Co. Ltd., Zhongshan (CN)

(72) Inventor: Qing-Kun Guo, Taichung (TW)

(73) Assignee: ZHONGSHAN SANFAN ELECTRICAL Appliance Co., Ltd., Zhongshan (CN)

( * ) Notice: Subject to any disclaimer, the term of this patent is extended or adjusted under 35 U.S.C. 154(b) by 0 days.

(21) Appl. No.: 18/792,238

(22) Filed: Aug. 1, 2024

(51) Int. Cl.
*F04D 25/08* (2006.01)
*F04D 29/34* (2006.01)
*F04D 29/64* (2006.01)

(52) U.S. Cl.
CPC ..... *F04D 25/088* (2013.01); *F04D 29/34* (2013.01); *F04D 29/646* (2013.01)

(58) Field of Classification Search
CPC ..... F04D 25/088; F04D 29/34; F04D 29/646
See application file for complete search history.

(56) References Cited

U.S. PATENT DOCUMENTS 6,059,531 A * 5/2000 Tai ..... F04D 29/34 416/207
10,995,769 B2 * 5/2021 Norwood ..... F04D 25/088
11,761,454 B2 * 9/2023 Yao ..... F04D 25/088 416/244 R
2024/0271632 A1 * 8/2024 Botkin ..... F04D 25/088

* cited by examiner

*Primary Examiner* — Sabbir Hasan
(74) *Attorney, Agent, or Firm* — Sinorica International

(57) ABSTRACT

A ceiling fan blade installation structure includes a plurality of fastening units on a ceiling fan body. The fastening unit has an accommodating groove for accommodating a root of the blade. The fastening unit includes an elastic fastening piece. The blade has a corresponding retaining hole. When the root of the blade is inserted into the accommodating groove of the fastening unit, the elastic fastening piece is locked in the retaining hole of the blade, such that the blade is fixed to the ceiling fan body. The blades can be quickly assembled on the ceiling fan body, which shortens the installation time of the blades greatly and reduces the risk of the installer falling.

8 Claims, 4 Drawing Sheets

CEILING FAN BLADE INSTALLATION STRUCTURE

FIELD OF THE INVENTION

The present invention relates to a ceiling fan, and more particularly to a ceiling fan blade installation structure.

BACKGROUND OF THE INVENTION

In a conventional ceiling fan blade mounting structure, blades and a blade bracket are locked to a ceiling fan body with bolts. It is relatively cumbersome and time-consuming to assemble the blades. The more blades, the longer it takes, especially for fans that require the motor to be suspended from the ceiling before the blades are installed. Besides, the conventional ceiling fan blade mounting structure still has the following shortcomings:

1. The installer stands on the ladder and works alone. It is difficult to align the blades with the locking holes of the blade bracket, and it is easy to cause damage to the blades when locking the screws.
2. It is easy to bend the blades or the screws are not tightened, resulting in unbalanced oscillation of the fan.
3. Because the installer has to stand on the ladder for a long time, there is a risk of falling and getting hurt.

Accordingly, the inventor of the present invention has devoted himself based on his many years of practical experiences to solve these problems.

SUMMARY OF THE INVENTION

The primary object of the present invention is to provide a ceiling fan blade installation structure for blades to be assembled and disassembled quickly.

In order to achieve the above object, the present invention provides a ceiling fan blade installation structure, comprising a ceiling fan body and a plurality of fastening units. The fastening units are equidistantly mounted in an annular groove of the ceiling fan body. The fastening units each have a base and a press plate. The base is fixed on the ceiling fan body. Two sides of the press plate are fixed on two sides of the base. The press plate is parallel to a top of the base. An accommodating groove is formed between the base and the press plate. The accommodating groove has an opening facing an outer side of the ceiling fan body. The press plate has a through hole and an elastic fastening piece in the through hole. The elastic fastening piece has an outer end that is defined as a fixed end and fixed to the press plate and an inner end that is defined as a free end and extends obliquely into the accommodating groove.

DETAILED DESCRIPTION OF THE PREFERRED EMBODIMENTS

Embodiments of the present invention will now be described, by way of example only, with reference to the accompanying drawings.

Figure 1:
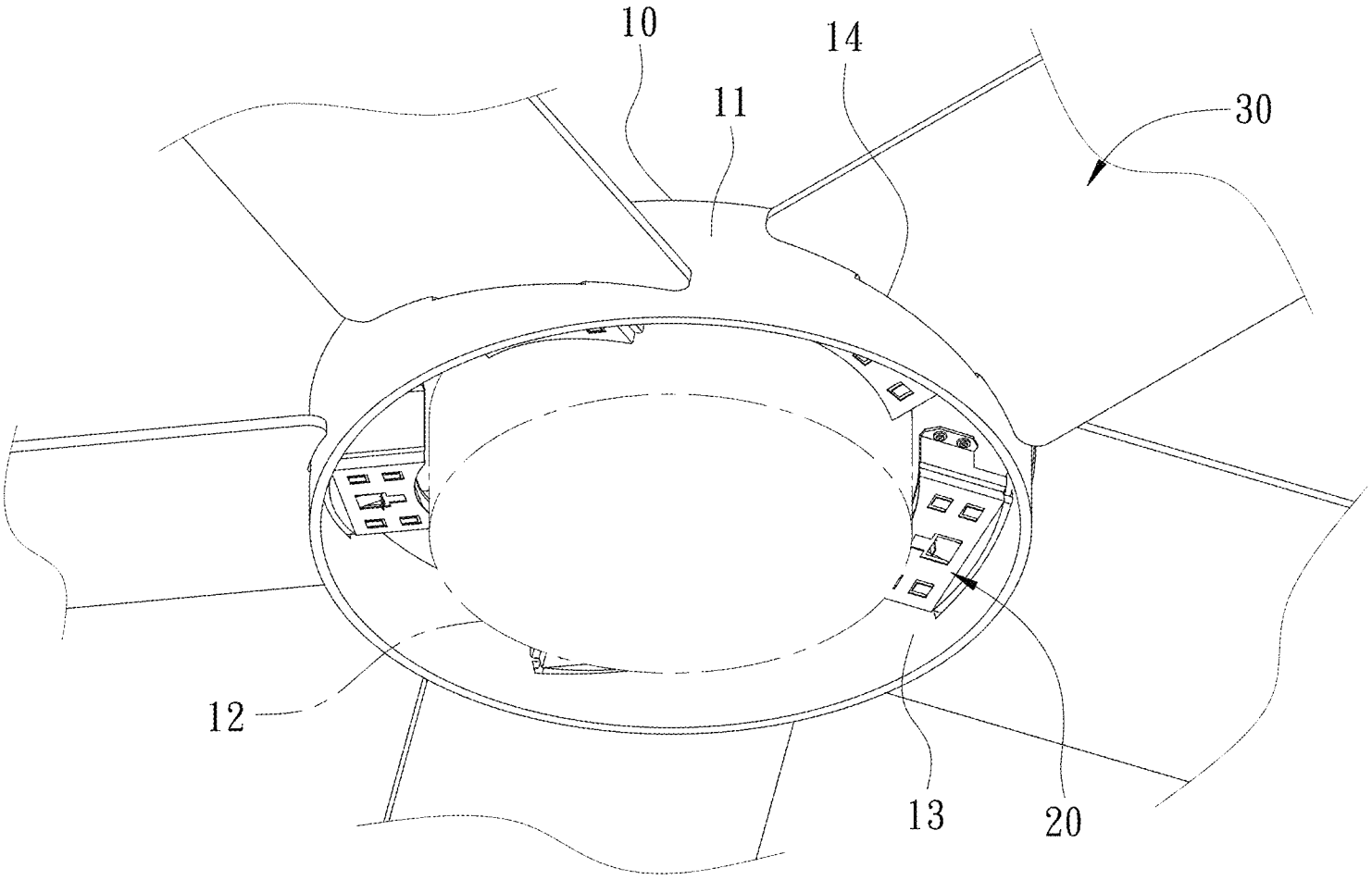
FIG. 1 is a perspective view of the ceiling fan according to a preferred embodiment of the present invention.
Figure 2:
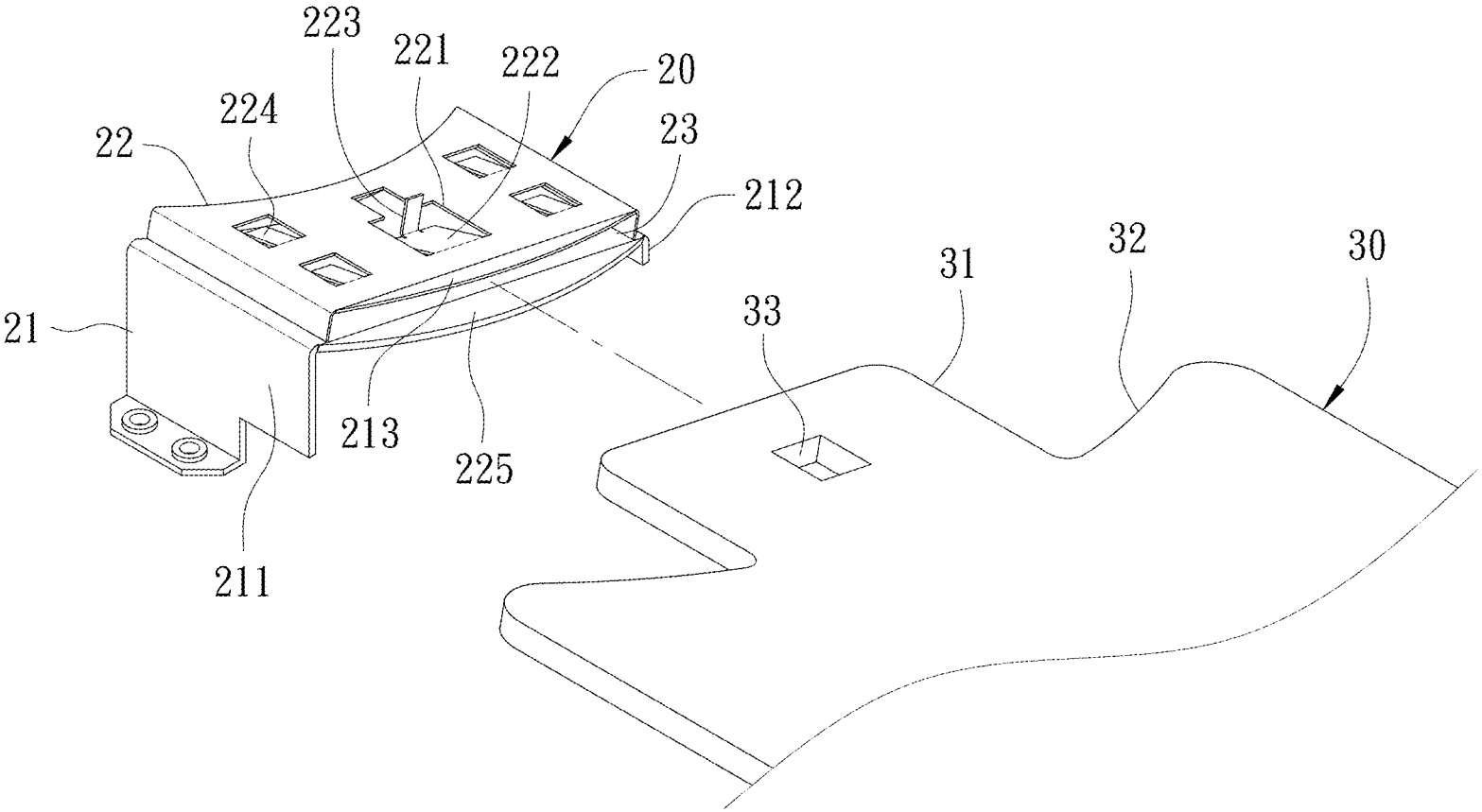
FIG. 2 is an exploded view of the fastening unit and the blade according to the preferred embodiment of the present invention.
Figure 3:
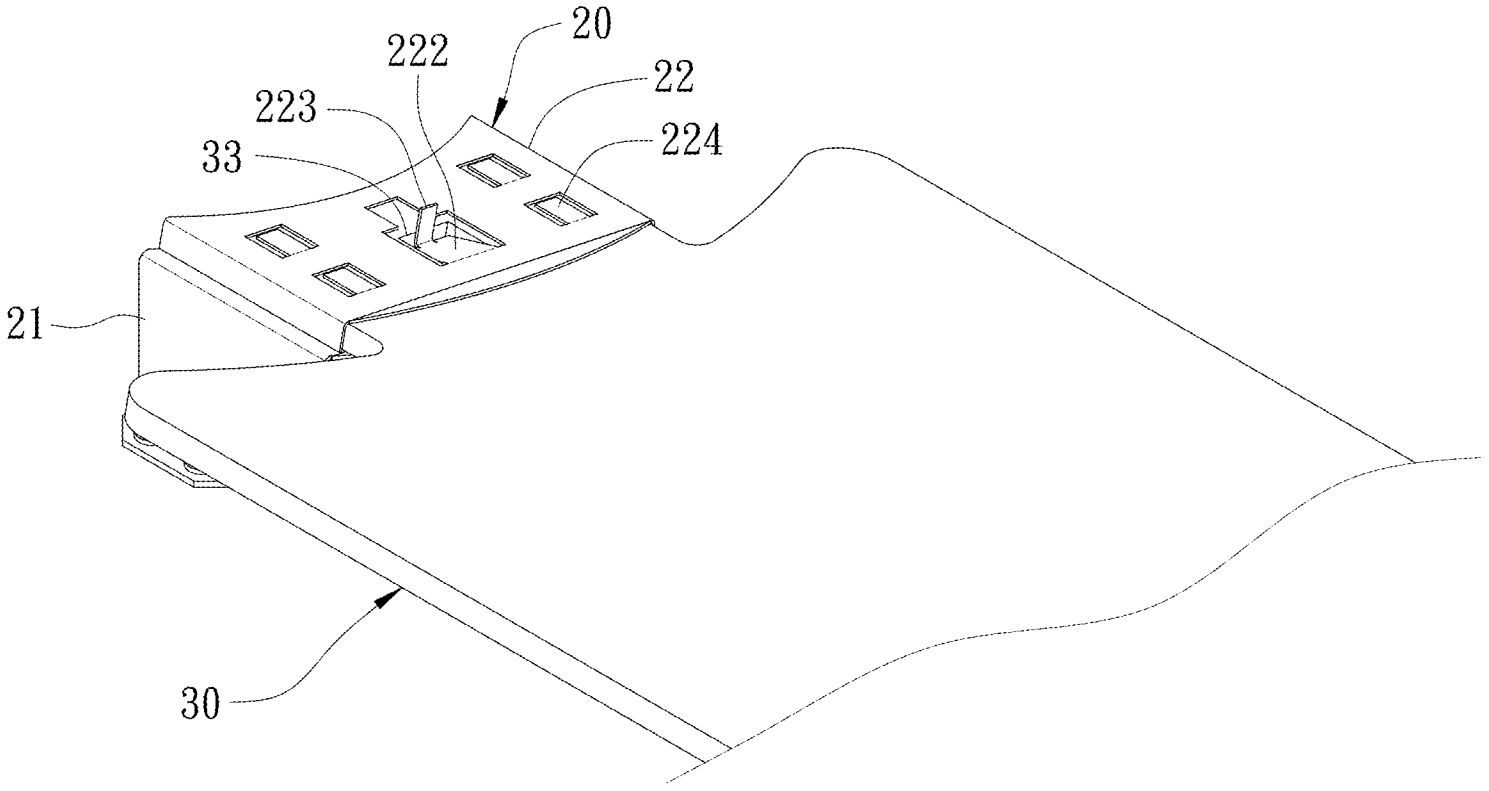
FIG. 3 is a perspective view of the fastening unit and the blade according to the preferred embodiment of the present invention.
Figure 4:
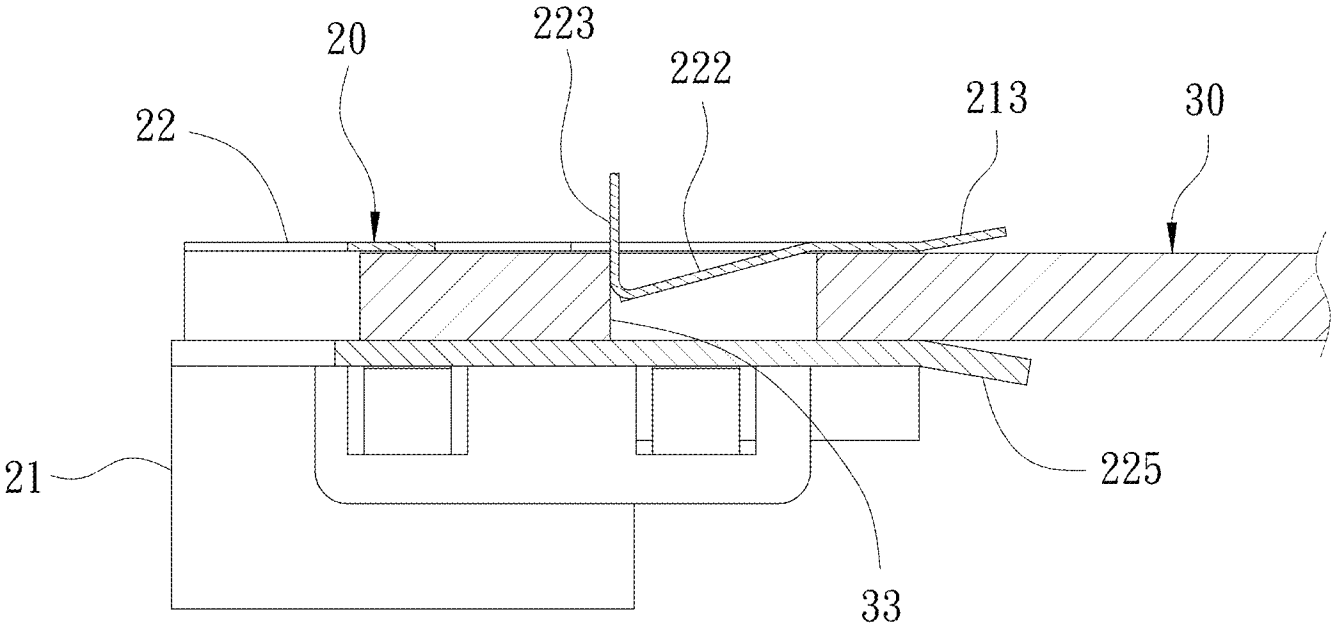
FIG. 4 is a cross-sectional view of the fastening unit and the blade according to the preferred embodiment of the present invention.

Referring to FIG. 1 through FIG. 4, a ceiling fan blade installation structure according to a preferred embodiment of the present invention comprises a ceiling fan body 10, a plurality of fastening units 20, and a plurality of blades 30. There are five fastening units 20 and five blades 30 in this embodiment. For the sake of simplicity, FIGS. 2 to 4 illustrate the assembly of one of the fastening units 20 and one of the blades 30, and FIGS. 2 to 4 are inverted from FIG. 1.

As shown in FIG. 1, the ceiling fan body 10 has an annular housing 11, a motor mounting seat 12 in the annular housing 11, and an annular groove 13 between the motor mounting seat 12 and the annular housing 11. The annular housing 11 has a plurality of elongate openings 14 that are inclined in the same direction and spaced at equal intervals.

As shown in FIG. 2 through FIG. 4, the fastening units 20 are equidistantly mounted in the annular groove 13. Each fastening unit 20 has a base 21 and a press plate 22. The base 21 has a first foot 211 and a second foot 212 with different heights on two sides thereof. The base 21 is locked in the annular groove 13 of the ceiling fan body 10 through the first foot 211 and the second foot 212. The base 21 has an oblique top corresponding to the elongate opening 14. Two sides of the press plate 22 are fixed on two sides of the base 21. The press plate 22 is parallel to the top of the base 21. An accommodating groove 23 is formed between the base 21 and the press plate 22. The opening at the front end of the accommodating groove 23 faces the outer peripheral side of the ceiling fan body 10 and corresponds to the elongate opening 14 of the annular housing 11. The press plate 22 has a through hole 221 and an elastic fastening piece 222 in the through hole 221. The elastic fastening piece 222 has an outer end that is defined as a fixed end and fixed to the press plate 22 and an inner end that is defined as a free end and extends obliquely into the accommodating groove 23. The free end of the elastic fastening piece 222 has a holding piece 223 facing upward. The press plate 22 has a plurality of elastic press pieces 224. One end of the elastic press piece 224 is defined as a fixed end and fixed to the press plate 22, and the other end of the elastic press piece 224 is defined as a free end and extends obliquely into the accommodating groove 23. The front edge of the top of the base 21 has an upper guide plate 213 inclining upward. The front edge of the top of the press plate 22 has a lower guide plate 225 inclining downward. The front edges of the upper guide plate 213 and the lower guide plate 224 are curved and correspond in shape to the inner peripheral surface of the annular housing 11, so that the front edges of the upper guide plate 213 and the lower guide plate 225 lean against the inner peripheral surface of the annular housing 11.

As shown in FIG. 2 through FIG. 4, each blade 30 has a root 31 at one end thereof. The root 31 corresponds in shape to the accommodating groove 23. The width of the root 31 is less than the width of the blade 30, so that a shoulder 32 is formed between the blade 30 and the root 31. The shoulder 32 is curved and corresponds in shape to the outer peripheral surface of the annular housing 11, so that the shoulder 32 leans against the outer peripheral surface of the annular housing 11. The root 31 of the blade 30 has a retaining hole 33 corresponding in position to the elastic fastening piece 222. The root 31 of the blade 30 is inserted into the accommodating groove 23 via the elongate opening 14 of the annular housing 11, and the elastic fastening piece 222 is engaged in the retaining hole 33 of the blade 30 with the holding piece 223 to lean against the side wall of the retaining hole 33, such that the blade 30 is fixed on the ceiling fan body 10.

In order to further understand the structural features, technical means and expected effects of the present invention, the assembly of the present invention is described below.

When the blade 30 is to be installed on the ceiling fan body 10, the blade 30 is inserted in the elongate opening 14 of the annular housing 11. The root 31 of the blade 30 is guided and inserted into the accommodating groove 23 through the guide of the upper guide plate 213 and the lower guide plate 225. When the shoulder 32 leans against the outer circumferential surface of the annular housing 11, the elastic fastening piece 222 is locked in the retaining hole 33 of the blade 30 and the holding piece 223 leans against the side wall of the retaining hole 33, such that the blade 30 is fixed on the ceiling fan body 10. In this way, the assembly of the present invention is completed. As the elastic press pieces 224 press the blade 30 tightly against the base 21, the blade 30 will not swing up and down during rotation. The elastic fastening piece 222 of the fastening unit 20 is engaged in the corresponding retaining hole 33 of the blade 30, which can prevent the blade 30 from being thrown outward due to the centrifugal force of rotation of the blade 30.

When the blade 3 is to be detached from the ceiling fan body 10, the holding piece 223 is pulled outward so that the elastic fastening piece 222 is disengaged from the retaining hole 33. At this time, the blade 30 is pulled outward and separated from the ceiling fan body 10 to complete the disassembly of the blade 30.

According to the above description, after the ceiling fan body of the present invention is mounted to the ceiling, the blades are accurately inserted in and secured to the ceiling fan body. The operation is simple. There is no need for the installer to stand on the ladder for a long time to tighten the blades with screws. It shortens the blade installation time greatly and reduces the risk of the installer falling.

It is worth mentioning that the fastening unit of the present invention may be installed on a ceiling fan body without a housing or on a blade bracket, both of which can achieve the same effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan blade installation structure, comprising:

a ceiling fan body, a plurality of fastening units, equidistantly mounted on an outer circumference of the ceiling fan body, the fastening units each having a base and a press plate, the base being fixed on the ceiling fan body, two sides of the press plate being fixed on two sides of the base, the press plate being parallel to a top of the base, an accommodating groove being formed between the base and the press plate, the accommodating groove having an opening facing an outer side of the ceiling fan body, the press plate having a through hole and an elastic fastening piece in the through hole, the elastic fastening piece having an outer end that is defined as a fixed end and fixed to the press plate and an inner end that is defined as a free end and extends obliquely into the accommodating groove;

a plurality of blades, each having a root at one end thereof, the root corresponding in shape to the accommodating groove, the root having a retaining hole corresponding in position to the elastic fastening piece, the root being inserted into the accommodating groove, the elastic fastening piece being locked in the retaining hole.

2. The ceiling fan blade installation structure as claimed in claim 1, wherein the free end of the elastic fastening piece has a holding piece facing upward.

3. The ceiling fan blade installation structure as claimed in claim 1, wherein a front edge of the base has an upper guide plate inclining upward, and a front edge of the press plate has a lower guide plate inclining downward.

4. The ceiling fan blade installation structure as claimed in claim 3, wherein front edges of the upper guide plate and the lower guide plate are curved.

5. The ceiling fan blade installation structure as claimed in claim 1, wherein the press plate has at least one elastic press piece, one end of the elastic press piece is defined as a fixed end and fixed to the press plate, and another end of the elastic press piece is defined as a free end and extends obliquely into the accommodating groove.

6. The ceiling fan blade installation structure as claimed in claim 1, wherein the two sides of the base have a first foot and a second foot with different heights, so that the top of the base is oblique.

7. The ceiling fan blade installation structure as claimed in claim 6, wherein the ceiling fan body has an annular housing, a motor mounting seat in the annular housing, and an annular groove between the motor mounting seat and the annular housing, the fastening units are equidistantly disposed in the annular groove, and the annular housing has a plurality of elongate openings inclining in a same direction and each corresponding to the opening of the accommodating groove.

8. The ceiling fan blade installation structure as claimed in claim 7, wherein the root has a width less than that of the blade, a shoulder is formed between the blade and the root, the shoulder is curved and corresponds in shape to an outer peripheral surface of the annular housing, so that the shoulder leans against the outer peripheral surface of the annular housing.

* * * * *